United States Patent [19]

Cimochowski et al.

[11] 4,339,902

[45] Jul. 20, 1982

[54] MULTIPLE LAYER THERMAL INSULATION DEVICE

[75] Inventors: Anthony E. Cimochowski, Sedalia; Brad A. Heffelmire, Littleton, both of Colo.

[73] Assignee: Manville Service Corporation, Denver, Colo.

[21] Appl. No.: 164,477

[22] Filed: Jun. 30, 1980

[51] Int. Cl.[3] ..... E04B 1/38; E04C 1/40

[52] U.S. Cl. ..... 52/506; 52/404; 52/509; 52/796; 52/797; 428/184; 428/121; 428/176

[58] Field of Search ..... 52/506, 509, 508, 404, 52/408, 796, 797; 428/184, 121, 176

[56] References Cited

U.S. PATENT DOCUMENTS

| | | | |
|---|---|---|---|
| 946,772 | 1/1910 | Coleman | 52/408 |
| 2,050,074 | 8/1936 | Trytten | 52/796 |
| 2,454,175 | 11/1948 | Hlavaty . | |
| 2,840,500 | 6/1958 | Okoomian et al. | 428/184 |
| 3,819,468 | 6/1974 | Sauder et al. . | |
| 3,832,815 | 9/1974 | Balaz et al. . | |
| 3,935,360 | 1/1976 | Brown | 428/184 |
| 3,975,882 | 8/1976 | Walter | 52/797 X |
| 4,001,996 | 1/1977 | Byrd, Jr. . | |
| 4,055,434 | 10/1977 | Chen et al. . | |
| 4,055,926 | 11/1977 | Byrd, Jr. . | |
| 4,086,737 | 5/1978 | Byrd, Jr. . | |
| 4,089,783 | 5/1978 | Holyoak . | |
| 4,103,469 | 8/1978 | Byrd, Jr. . | |
| 4,123,886 | 11/1978 | Byrd, Jr. . | |
| 4,287,839 | 9/1981 | Severin | 52/506 X |

FOREIGN PATENT DOCUMENTS

| | | | |
|---|---|---|---|
| 347333 | 8/1960 | Switzerland | 52/404 |

*Primary Examiner*—Alfred C. Perham

*Attorney, Agent, or Firm*—Robert M. Krone; Joseph J. Kelly; Richard K. Thomson

[57] ABSTRACT

A thermal insulation device is described comprising a modular or block insulation composed of at least two layers of serpentine folded fibrous insulating blankets with the layers of blankets being secured by means of extended folds of the hot face layer being interengaged with folds of the cold face layer, with the cold face layer then being separately secured to attachment means for mounting the block on the wall, ceiling, door or other surface of a furnace, kiln or like structure. The layers of fiber are commonly composed of fibers of different compositions, with the more thermally resistant fiber comprising the outer or hot face layer and the less thermally resistant composition comprising the inner or cold face layer.

4 Claims, 2 Drawing Figures

MULTIPLE LAYER THERMAL INSULATION DEVICE

TECHNICAL FIELD

The invention herein relates to thermal insulations. More particularly it relates to "modular" thermal insulation devices formed of fibrous insulating materials.

BACKGROUND OF PRIOR ART

In recent years "modular" thermal insulation devices have come into widespread use. These are blocks of thermal insulation fitted with means to attach them to the walls of furnaces and similar high temperature units. The modules or blocks usually have about 1 $ft^2$ (930 $cm^2$) faces and have an insulation material depth of from 4 to 12 inches (10 to 30 cm). A typical module or block is shown in U.S. Pat. No. 4,001,996 to C.O. Byrd, Jr.; modules of this type are commercially available under the trademark "Z-BLOK" from the Johns-Manville Corporation and its licensees.

All of the various prior art devices of this modular type have consisted of single layers of insulating fiber, and the fiber depth is obtained by folding the fiber as shown in the aforementioned Byrd patent or by having straight fibers of predetermined lengths, such as shown in U.S. Pat. No. 3,832,815. Varying the depth of the single layer of fiber suffices for many different types of insulation requirements, so that the desired temperature drop from the hot face of the blanket to the cold face is obtained. Because there is only a single fiber layer, however, the module must be constructed throughout with fiber which can withstand the hot face temperature. For lower temperature service where relatively inexpensive fibrous materials provide adequate insulation, this is not a particularly serious detriment. Where the hot face temperature is above about 1200° F. (650° C.) and particularly where it is above about 1800° F. (980° C.), the limitations of single layer construction become much more evident. Fibrous materials designed to withstand these high hot face temperatures must be formed from quite pure raw materials and under rather demanding formation conditions, and consequently are quite high in cost. Because there is normally a substantial temperature drop across the depth of a fiber insulating module (which temperature drop is greater the greater the depth of the module), the cold face side of the module normally does not require such high temperature service properties in the fiber. However, since the block is made of only a single type of fiber, the expensive high temperature resistant fiber must be used for the entire block. This effectively wastes costly fiber at the back of the module where its properties are not needed and significantly adds to the cost of the finished module.

Attempts have been made to overcome this problem by attaching high temperature fiber layers to the hot face of the blocks by various complex mechanical means; see, e.g., U.S. Pat. Nos. 4,055,926; 4,086,737; 4,103,469 and 4,123,886, all to the aforementioned C.O. Byrd, Jr.

It would therefore be of considerable interest to have available a modular or block thermal insulating device which would permit one to utilize high temperature resistant fiber at the hot face thereof and fiber of lesser temperature resistance at the cold face thereof, while providing for a simple means of securing the layers of fiber together.

BRIEF DESCRIPTION OF THE INVENTION

The invention herein resides in a thermal insulating device adapted to be affixed to the wall of a furnace or like structure and having a hot face and a cold face, the cold face being adjacent to the wall and the hot face being the surface exposed to the highest service temperature when the device is in use. The device comprises (a) a first insulation layer comprising a first serpentine folded fibrous insulating blanket; (b) attachment means secured to the first insulation layer and adapted to affix the device to the wall, the first insulation layer thereby providing the cold face of the device; (c) a second insulation layer comprising a second serpentine folded fibrous insulating blanket, the second insulation layer abutting the first insulation layer on the surface of the first insulation layer opposite to the surface to which the attachment means is secured, the second insulation layer thereby providing the hot face of the device; and (d) at least one of the folds of the second insulating blanket extending from the second insulation layer into the first insulation layer and being disposed within one of the folds of the first insulating blanket to a depth sufficient to retain the first insulation layer and second insulation layer in abutting relationship without the need for additional mechanical connections therebetween. In one embodiment, the second insulation layer itself comprises a plurality of insulating blankets having folds interengaged in the same manner as the interengagement of the folds of the first and second insulating blankets described in (d) above. In a preferred embodiment, a plurality of folds from the second insulation layer are interengaged with folds in the first insulation layer as described in (d) above.

DETAILED DESCRIPTION OF THE INVENTION

Figure 1:
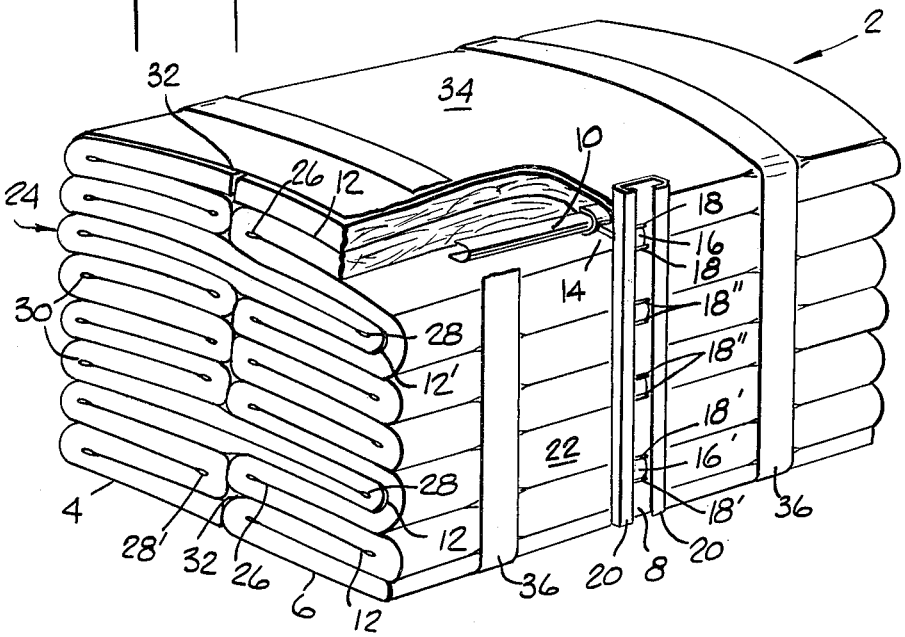
FIGS. 1 and 2 of the drawings show two views of an insulation device of the present invention, FIG. 1 being a perspective view showing the device ready for installation and FIG. 2 being an end view showing only the serpentine blanket structure.
Figure 2:
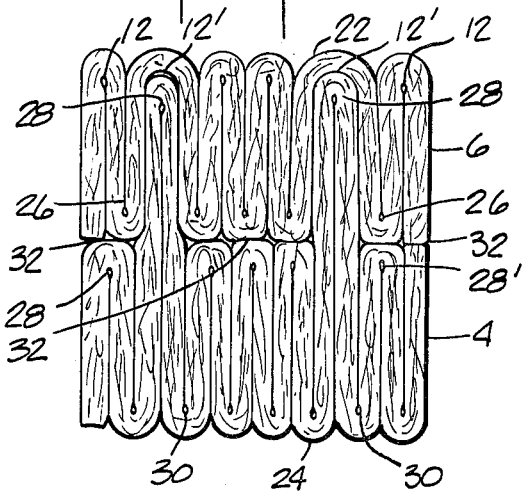

The invention herein will be most readily understood by reference to the drawings. FIG. 1 shows a single block or module 2 of the present invention in the form in which it is normally shipped and handled for installation. The block 2 as shown is composed of two fibrous insulating blankets 4 and 6. (for ease of reference herein these will be designated as the "hot face layer" 4 and "cold face layer" 6.) Secured to the outer surface of cold face layer 6 is attachment means 8. For the purposes of the present invention, it is necessary only to state that the attachment means 8 is secured to the cold face layer 6 by means of a bar 10 which is embedded in an inner fold 12 of the cold face layer blanket and is attached to the attaching means 8 by a connector 14 which is folded over into tabs 16 which contact attachment means 8 through slots 18. Normally in the modular blocks 2 of this type there are at least two such means of attachment of the cold face layer 6 to the attachment means 8; in FIG. 1 a second attachment means is indicated by the reference numerals 16' and 18'. It will also be noted that additional slots 18'' are provided in attachment means 8 for the use of more securing devices if desired. The attachment means 8 is in the form of a C-shaped channel and is mounted to a furnace wall by first placing a flanged mounting clip (not shown) against the furnace wall and then sliding the C-shaped attachment means 8 over the clip so that the flanges 20 of attachment means 8 engage the flanges of the mounting clip.

The thermal insulation layer structure is composed of a series of serpentine folds in both layers 4 and 6. Normally such serpentine folded blankets are formed mechanically from a continuous strip of fiber blanket of the desired width. A suitable machine for constructing such folds is described in copending U.S. patent application Ser. No. 921,682 to R. N. Cunningham and D. D. Smith, now U.S. Pat. No. 4,218,962. An individual unit or block 2 may contain as many folds in each layer as desired, but it is common to have approximately seven or eight folds when 1 inch (2.5 cm) nominal thickness blanket is used to make the folded layers. It will be noticed that in each of the layers 4 and 6 the directions of the folds alternate. For convenience herein, those folds which terminate closest to the cold face 22 of the block 2 (i.e., the surface of the block which is adjacent to the furnace wall after insulation and thus is subjected to the lowest temperatures) will be designated as "inner folds" and those folds which terminate in a direction toward the hot face 24 of the block 2 (i.e., the surface of the block which is directly exposed to the heat of the furnace when in service) will be designed as "outer folds." It will be seen that the bar 10 for securing the cold face layer 6 to attaching means 8 is always located in an inner fold 12 rather than an outer fold 26 of cold face layer 6.

The critical feature of the present invention resides in the interengagement of certain extended inner folds 28 of layer 4 within certain inner folds 12' of cold face layer 6. Layer 4 is composed of a serpentine pattern of which many of the inner folds (designated 28') and all of the other folds 30 are of a uniform depth. At intervals along the serpentine hot face layer 4, however, are extended inner folds 28 which project inwardly (i.e., toward the cold face 22) from hot face layer 4. Each of these extended inner layers 28 is inserted into an expanded inner fold 12' of cold face layer 6 as shown in the Figures. Normally each extended fold 28 will extend for the full depth of the expanded inner fold 12' to maximize the interengagement between the two folds and thus maximize the compressive and frictional forces securing hot face layer 4 to cold face layer 6. In the Figures, two extended inner layers 28 are shown for a single module or block 2. This use of two folds is preferred as it has been found that this number of engaged folds is entirely adequate to provide secure connection between the layers 4 and 6. However, if desired, any number of interengaged folds 28 and 12' can be used for each module or block 2, ranging from a single interengaged pair of folds 28 and 12' to having every single inner fold of layer 4 be extended. Neither of these extremes is preferred, however, since a single interengaged pair of folds 28 and 12' may not provide a sufficiently secure connection between the layers 4 and 6, and use of a large number of interengaged pairs of folds 28 and 12' tends to defeat the purpose of the invention by requiring excessive amounts at depth of the fibrous insulating blanket comprising hot face layer 4.

The extended folds 28 can be formed in a variety of different ways. For instance, one can simply invert by hand one of the outer folds 30 to form an extended fold 28 which is of the same length as the serpentine folds of the hot face layer 4. Alternatively, a machine could be programmed to form such an inverted fold at predetermined intervals while forming the rest of the normal folds in hot face layer 4. In another embodiment, a machine could be programmed to make normal folds but at regular intervals to form folds of greater length, which folds would then serve as the extended folds 30. In this last embodiment, the longer folds could be of any desired length, and would not be limited to having an extended portion of the same length as the regular folds, as results when the regular folds are simply inverted.

It will be noted that the only connection between the layers 4 and 6, even though they abut at interface 32, is the engagement between the surfaces of folds 28 and 12'. Since the two layers are made of fibrous materials, this surface engagement provides considerable mechanical interlocking of surface fibers and strong frictional forces tending to resist having fold 28 come out of fold 12, so that separate or external mechanical connecting devices (such as clips or thread) are not needed. Further, when the modules are assembled on the furnace wall in the conventional parquet pattern (described, e.g., in U.S. Pat. No. 3,819,468), the adjacent blocks 2 exert compressive forces against each other which tend to force the folds 12' closed and thus more tightly grip the extended folds 28. These compressive forces of adjacent blocks are normally obtained by manufacturing the blocks so that the folds of the layers 4 and 6 are somewhat compressed prior to installation of the block in a furnace or similar structure. In order to maintain this compression it is common to wrap three sides of the block 2 with cardboard or similar strong sheet material 34 and secure the material 34 in place with bands 36. After the individual modules or blocks are attached to the furnace wall and the parquet structure is established, a workman goes back and cuts each band 36, allowing the material 34 and bands 36 to be removed. The compressive forces to which the layers 4 and 6 have been previously subjected are thus relieved allowing the layers to expand outward. However, because of the parquet arrangement of the adjacent blocks, the layers do not move by any significant amount but rather transfer the compressive forces to the next adjacent block. This not only has the advantage of providing additional securing for the extended folds 28 in the present invention, but also tends to close up spaces between adjacent blocks which would otherwise serve as heat flow passages and reduce the efficiency of the insulating lining of the furnace or similar structure.

The drawings herein show two layers 4 and 6, which is the preferred embodiment of the present invention. It will be understood, however, that the concept of the interengaged folds shown for two layers is equally applicable to additional layers of thermal insulating blanket, so that a structure having three, four or more layers is possible. The two layer embodiment is much preferred, however, because the degree of securement becomes decidedly less for layers extending further out from the cold face. In addition, the temperature drop across an insulating module of conventional depth (4 to 12 inches; 10 to 30 cm) is normally not great enough to justify the use of more than two different types of fiber blankets, as will be described below.

Each of the layers 4 and 6 (and additional layers, if any) will normally be composed of insulating fibers. Normally the fibers in the hot face layer 4 will be different from the fibers in cold face layer 6, in that they will be significantly more temperature resistant. Among the various fiber combinations which can be used include: a hot face layer 4 composed of alumina fibers (3000° F./1670° C. service temperature) and a cold face layer 6 composed of silica/alumina/chromia fibers (2600° F./1430° C. service temperature); a hot face layer 4 composed of the aforementioned silica/alumina/chromia fibers and a cold face layer 6 composed of conventional aluminosilicate fibers (2300° F./1260° C. service temperature); a hot face layer 4 composed of the aforementioned aluminosilicate fibers and a cold face layer 6 composed of any of the fibers described in U.S. Pat. No. 4,055,434 to A. B. Chen and J. M. Pallo (1400° F.–2000° F./760° C.–1090° C. service temperature); or a hot face layer 4 composed of the aforementioned fibers of U.S. Pat. No. 4,055,434 and a cold face layer 6 composed of any conventional glass fiber, mineral wool fiber or rock wool fiber. Other combinations, such as the silica/alumina/chromia fibers in the hot face layer 4 backed up by the fibers of U.S. Pat. No. 4,055,434 in the cold face layer 6 may also be used if the thickness of the hot face layer 4 is sufficient to reduce the temperature at the interface 32 to a temperature within the service range of the fibers composing the cold face layer 6. Determination of the appropriate fiber for use in the hot face layer 4 will be dependent upon the temperature at hot face 24, while the determination of the appropriate fiber to use in the cold face layer 6 will be dependent upon the temperature at the interface 32; the latter temperature will be dependent on both the temperature at hot face 24 and the thickness of hot face layer 4 as well as the degree of heat transfer through hot face layer 4.

While normally the fibers in the two layers will be of different compositions, it is possible to have fibers of the same compositions in each layer. While this, of course, gives no added thermal or cost advantage, it may be used to simplify repair of thermal blocks where surface damage to a block is a common problem. Thus where such blocks are surface damaged on their hot face, one would only need to remove the outer or hot face layer 4 and replace it with a new hot face layer 4 by wedging the folds 28 of the replacement hot face layer 4 into the folds 12' of the existing cold face layer 6. Such a system would also be advantageous where repair of a damaged block could not be immediately undertaken, since even if the hot face 4 where torn away while the furnace was in service, the remaining cold face layer 6 would provide some degree of thermal insulation, thus avoiding total heat loss through the damaged section.

STATEMENT OF INDUSTRIAL APPLICATION

The modular blocks of the present invention are useful in a wide variety of thermal insulation applications. They may be used to line the interiors of industrial furnaces, kilns and similar high temperature industrial apparatus. In such devices, they may be used to line walls, ceilings, doors and any other surfaces through which heat loss is to be avoided. Specific applications of such furnaces and kilns are found in pottery and ceramic industries, steel industries and glass industries. Other related devices are used in the annealing of glassware such as bottles and window glass, baking of paints and coatings and annealing of metal objects.

We claim:

1. A thermal insulating device adapted to be affixed to a surface of a furnace or like structure and having a hot face and a cold face, said cold face being adjacent to said surface and said hot face being exposed to the highest service temperature in the furnace or like structure when said insulating device is in use, said insulating device comprising:

(a) a first insulation layer comprised of a first serpentine folded fibrous insulating blanket defining a first plurality of inner and outer folds, said first inner folds being nearest said cold face and said first outer folds being nearest said hot faces;

(b) attachment means secured to said first insulation layer and adapted to affix said device to said surface of said furnace or like structure, said first insulation layer thereby providing the cold face of said device;

(c) a second insulation layer comprised of a second serpentine folded fibrous insulating blanket defining a second plurality of inner and outer folds, said second inner folds being nearest the cold face and said second outer folds being nearest said hot face, some of the inner folds of said second insulation layer abutting the outer folds of said first insulation layer, said second insulation layer thereby providing the hot face of said device; and (d) at least one of the inner folds of said second serpentine folded fibrous insulating blanket extending from said second insulation layer into said first insulation layer and being disposed within one of the inner folds of said first serpentine folded thermal insulating blanket to a depth sufficient to retain said first insulation layer and said second insulation layer in abutting relationship without the need for additional mechanical connections therebetween.

2. A device as in claim 1 wherein the insulating fibers comprising said first insulation layer are of different composition and have lower thermal resistance than the fibers comprising said second insulation layer.

3. A device as in claims 1 or 2 wherein a plurality of said inner folds of said second insulation blanket are disposed in a like plurality of said inner folds of said first insulation layer.

4. A device as in claim 3 wherein the two blankets are retained together by two pairs of interengaged folds.

* * * * *

UNITED STATES PATENT AND TRADEMARK OFFICE

CERTIFICATE OF CORRECTION

PATENT NO. : 4,339,902

DATED : July 20, 1982

INVENTOR(S) : Anthony Edward Cimochowski & Brad Alan Heffelmire

It is certified that error appears in the above—identified patent and that said Letters Patent is hereby corrected as shown below:

Claim 1, col. 6, line 22, "faces" is replaced by -- face --.

Signed and Sealed this

*Twelfth* Day of *October 1982*

[SEAL]

*Attest:*

GERALD J. MOSSINGHOFF

*Attesting Officer*

*Commissioner of Patents and Trademarks*